US008047297B2

(12) United States Patent
Millheim et al.

(10) Patent No.: US 8,047,297 B2
(45) Date of Patent: Nov. 1, 2011

(54) SYSTEM FOR AND METHOD OF RESTRAINING A SUBSURFACE EXPLORATION AND PRODUCTION SYSTEM

(75) Inventors: Keith K. Millheim, The Woodlands, TX (US); Eric E. Maidla, Sugar Land, TX (US); Charles H. King, Austin, TX (US)

(73) Assignee: Anadarko Petroleum Corporation, The Woodlands, TX (US)

( * ) Notice: Subject to any disclaimer, the term of this patent is extended or adjusted under 35 U.S.C. 154(b) by 0 days.

(21) Appl. No.: 12/750,275

(22) Filed: Mar. 30, 2010

(65) Prior Publication Data

US 2010/0181074 A1 Jul. 22, 2010

Related U.S. Application Data

(63) Continuation of application No. 11/511,162, filed on Aug. 28, 2006, now abandoned.

(60) Provisional application No. 60/772,078, filed on Feb. 10, 2006.

(51) Int. Cl.
*E21B 17/01* (2006.01)

(52) U.S. Cl. ..... 166/367; 166/350; 166/364; 405/224.2; 405/171; 441/29

(58) Field of Classification Search ..... 166/367, 166/350–352, 364, 368; 405/224.2–224.4, 405/171; 441/28, 29
See application file for complete search history.

(56) References Cited

U.S. PATENT DOCUMENTS 2,988,144 A * 6/1961 Conrad ..... 166/352
3,525,388 A * 8/1970 McClintock ..... 166/356
3,572,041 A * 3/1971 Graaf ..... 405/205
3,708,811 A * 1/1973 Flory ..... 441/5
3,855,656 A * 12/1974 Blenkarn ..... 441/22
4,065,822 A * 1/1978 Wilbourn ..... 441/4
4,099,560 A * 7/1978 Fischer et al. ..... 166/350
4,223,737 A * 9/1980 O'Reilly ..... 166/336
4,234,047 A * 11/1980 Mott ..... 175/5
4,448,266 A * 5/1984 Potts ..... 175/7

(Continued)

*Primary Examiner* — Thomas Beach
*Assistant Examiner* — Matthew Buck
(74) *Attorney, Agent, or Firm* — Raymond R. Ferrera; Adams and Reese LLP

(57) ABSTRACT

A system for and method of limiting and controlling the unintended subsurface release of an exploration or production riser system is provided including one or more means for anchoring the riser or casing stack at one or more pre-determined points upon the length of the riser, and/or on the housing of an associated buoyancy chamber or the like, and/or on a particular portion of the riser as dictated by the operational environment, and/or on an anchor portion secured in the sea floor; and a network of restraining members disposed on the anchoring means. A lower anchoring portion includes one or more anchors disposed in communication with a wellhead, or with the sea floor or below the sea floor mud line, or with a well casing portion. A network of restraining members forms an essentially continuous connection from the buoyancy member portion to said bottom anchor portion. In a particular, though, non-limiting embodiment of the invention, a means for anchoring the system using pairs of anchors disposed at one or more predetermined points along the riser portion of the system is provided. Also disclosed is a variety of means and devices by which a surface vessel or a rig, etc., servicing a subsea well equipped with the present system may absorb or deflect impact forces originating from portions of the system that unexpectedly break free and rush upwards toward the surface vessel or rig.

28 Claims, 3 Drawing Sheets

U.S. PATENT DOCUMENTS 4,645,467 A * 2/1987 Pollack ..... 441/4
5,046,896 A * 9/1991 Cole ..... 405/195.1
5,657,823 A * 8/1997 Kogure et al. ..... 166/340
6,027,286 A * 2/2000 Pollack ..... 405/195.1
6,193,441 B1 * 2/2001 Fisher ..... 405/224.4
6,196,768 B1 * 3/2001 Allen et al. ..... 405/224
6,210,075 B1 * 4/2001 Korloo ..... 405/206
6,244,785 B1 * 6/2001 Richter et al. ..... 405/195.1
6,296,421 B2 * 10/2001 Fisher ..... 405/224.4
6,394,702 B2 * 5/2002 Fisher ..... 405/224.4
6,564,741 B2 * 5/2003 Nelson ..... 114/264
6,622,793 B1 * 9/2003 Rylov et al. ..... 166/364
7,458,425 B2 * 12/2008 Millheim et al. ..... 166/355

* cited by examiner

SYSTEM FOR AND METHOD OF RESTRAINING A SUBSURFACE EXPLORATION AND PRODUCTION SYSTEM

CROSS-REFERENCE TO RELATED APPLICATIONS

The present application is a continuation of U.S. Non-Provisional application Ser. No. 11/511,162 filed Aug. 28, 2006 now abandoned, which claims the benefit of prior U.S. Provisional Application No. 60/772,078, filed Feb. 10, 2006.

FIELD OF THE INVENTION

The present invention relates generally to methods and means for improving the stability and safety of offshore exploration and production systems, and, in a particular, though non-limiting embodiment, to a system for and method of restraining a self-standing casing riser system deployed in conjunction with an adjustable buoyancy chamber, or a functional equivalent thereof.

BACKGROUND OF THE INVENTION

Innumerable systems and methods have been employed in efforts to find and recover hydrocarbon reserves around the world. At first, such efforts were limited to land operations involving simple but effective drilling methods that satisfactorily recovered reserves from large, productive fields. As the number of known producing fields dwindled, however, it became necessary to search in ever more remote locales, and to move offshore, in the search for new resources. Eventually, sophisticated drilling systems and advanced signal processing techniques enabled oil and gas companies to search virtually anywhere in the world for recoverable hydrocarbons.

Initially, deepwater exploration and production efforts consisted of expensive, large scale drilling operations supported by tanker storage and transportation systems, due primarily to the fact that most offshore drilling sites are associated with difficult and hazardous sea conditions, and thus large scale operations provided the most stable and cost-effective manner in which to search for and recover hydrocarbon reserves. A major drawback to the large-scale paradigm, however, is that explorers and producers have little financial incentive to work smaller reserves, since potential financial recovery is generally offset by the lengthy delay between exploration and production (approximately 3 to 7 years) and the large capital investment required for conventional platforms and related drilling and production equipment. Moreover, complex regulatory controls and industry-wide risk aversion have led to standardization, leaving operators with few opportunities to significantly alter the prevailing paradigm. As a result, offshore drilling operations have traditionally been burdened with long delays between investment and profit, excessive cost overruns, and slow, inflexible recovery strategies dictated by the operational environment.

More recently, deepwater sites have been found in which much of the danger and instability present in such operations is avoided. For example, off the coast of Brazil, West Africa and Indonesia, potential drilling sites have been identified where surrounding seas and weather conditions are relatively mild and calm in comparison to other, more volatile sites such as the Gulf of Mexico and the North Sea. These recently discovered sites tend to have favorable producing characteristics, yield positive exploration success rates, and admit to production using simple drilling techniques similar to those employed in dry land or near-shore operations.

However, since lognormal distributions of recoverable reserves tend to be spread over a large number of small fields, each of which yield less than would normally be required in order to justify the expense of a conventional large-scale operation, these regions have to date been underexplored and underproduced relative to its potential. Consequently, many potentially productive smaller fields have already been discovered, but remain undeveloped due to economic considerations. In response, explorers and producers have adapted their technologies in an attempt to achieve greater profitability by downsizing the scale of operations and otherwise reducing expense, so that recovery from smaller fields makes more financial sense, and the delay between investment and profitability is reduced.

For example, in published Patent Application No. US 2001/0047869 A1 and a number of related pending applications and patents issued to Hopper et al., various methods of drilling deepwater wells are provided in which adjustments to the drilling system can be made so as to ensure a better recovery rate than would otherwise be possible with traditional fixed-well technologies. However, the Hopper system cannot be adjusted during completion, testing and production of the well, and is especially ineffective in instances where the well bore starts at a mud line in a vertical position. The Hopper system also fails to support a variety of different surface loads, and is therefore self-limiting with respect to the flexibility drillers desire during actual operations. The Hopper system also fails to contemplate any significant safety measures to protect the welfare of operating crews or the capital expenditure of investors.

In U.S. Pat. No. 4,223,737 to O'Reilly, a method is disclosed in which the problems associated with traditional, vertically oriented operations are addressed. The method of O'Reilly involves laying out a number of interconnected, horizontally disposed pipes in a string just above the sea floor (along with a blow out preventer and other necessary equipment), and then using a drive or a remote operated vehicle to force the string horizontally into the drilling medium. The O'Reilly system, however, is inflexible in that it fails to admit to practice while the well is being completed and tested. Moreover, the method fails to contemplate functionality during production and workover operations. As would therefore be expected, O'Reilly also fails to teach any systems or methods for improving crew safety or protecting operator investment during exploration and production. In short, the O'Reilly reference is helpful only during the initial stages of drilling a well, and would therefore not be looked to as a systemic solution for safely establishing and maintaining a deepwater exploration and production operation.

Other offshore operators have attempted to solve the problems associated with deepwater drilling by effectively "raising the floor" of an underwater well by disposing a submerged wellhead above a self-contained, rigid framework of pipe casing that is tensioned by means of a gas filled, buoyant chamber. Generally, this type of solution falls in the class of self-standing riser systems, since it typically includes a number of riser segments fixed in a rigid, cage-like structure likely to remain secure or else fail together as a integrated system. For example, as seen in prior U.S. Pat. No. 6,196,322 B1 to Magnussen, the Atlantis Deepwater Technology Holding Group has developed an artificial buoyant seabed (ABS) system, which is essentially a gas filled buoyancy chamber deployed in conjunction with one or more segments of pipe casing disposed at a depth of between 600 and 900 feet beneath the surface of a body of water. After the ABS wellhead is fitted with a blowout preventer during drilling, or with a production tree during production, buoyancy and tension are imparted by the ABS to a lower connecting member and all internal casings. The BOP and riser (during drilling) and production tree (during production), are supported by the lifting force of the buoyancy chamber. Offset of the wellhead is reasonably controlled by means of vertical tension resulting from the buoyancy of the ABS.

The Atlantis ABS system is relatively inefficient, however, in several practical respects. For example, the '322 Magnussen patent specifically limits deployment of the buoyancy chamber to environments where the influence of surface waves is effectively negligible, i.e., at a depth of more than about 500 feet beneath the surface. Those of ordinary skill in the art will appreciate that deployment at such depths can be an expensive and relatively risk-laden solution, given that installation and maintenance can only be carried out by deep sea divers or remotely operated vehicles, and the fact that a relatively extensive transport system must still be installed between the top of the buoyancy chamber and the bottom of an associated recovery vessel in order to initiate production from the well.

The Magnussen system also fails to contemplate multiple anchoring systems, even in instances where problematic drilling environments are likely to be encountered. Moreover, the system lacks any control means for controlling adjustment of either vertical tension or wellhead depth during production and workover operations, and expressly teaches away from the use of lateral stabilizers that could enable the wellhead to be deployed in shallower waters subject to stronger tidal and wave forces. The Magnussen disclosure also fails to contemplate any safety features that would protect the crew and equipment associated with an operation in the event of a sudden, unintended release of the fluid transport cage.

In published Patent Application US 2006/0042800 A1 to Millheim, et al., however, a system and method of establishing an offshore exploration and production system is disclosed in which a well casing is disposed in communication with an adjustable buoyancy chamber and a well hole bored into the floor of a body of water. A lower connecting member joins the well casing and the chamber, and an upper connecting member joins, the adjustable buoyancy chamber and a well terminal member. The chamber's adjustable buoyancy enables an operator to vary the height or depth of the well terminal member, and to vary the vertical tension imparted to drilling and production strings throughout exploration and production operations. Also disclosed is a system and method of adjusting the height or depth of a wellhead while associated vertical and lateral forces remain approximately constant. A variety of well isolation members, lateral stabilizers and anchoring means, as well as several methods of practicing the invention, are also disclosed. There is, however, little detailed discussion of safety features useful in the event of an unintended release of system components.

Thus, presently known offshore exploration and production systems, especially those relying on the so-called self-standing riser type configuration, can be susceptible to a variety of potentially catastrophic system failures that could lead to damage or destruction of the drilling platforms and surface vessels disposed overhead (e.g., a pontoon type drilling rig floating on the surface of the ocean and disposed in communication with the riser system).

For example, casing connections, wellhead connections, buoyancy chambers connected to the riser stack, etc., can all fail, thereby creating an unsafe condition in which buoyancy and tension forces are suddenly released from a submerged captured system toward the surface of the water. When such a release of forces occurs, the components of the system—for example, a buoyancy chamber disposed in communication with several thousand feet of casing riser—are released toward the surface and can impact the rig and/or associated surface vessels servicing an offshore well. For purposes of this disclosure, it should be noted that while many of the detailed embodiments described below relate specifically to a single riser system and its functional equivalents, those of ordinary skill in the art should appreciate that aspects of the present invention are applicable to virtually any type of subsurface exploration and production system insofar as they relate to features drawn to limiting and controlling the deleterious effects of system components suddenly and unexpectedly released from tension.

SUMMARY OF THE INVENTION

According to a first aspect of the invention, there is provided a method for restraining and, at least to some degree, controlling the unintended subsurface release of exploration and production riser systems, in which the method comprises the steps of disposing one or more means for anchoring a riser system to either the sea floor or an underwater wellhead system; and disposing a network of associated restraining members in communication with the anchoring means.

Also provided is a system for restraining and controlling the unintended subsurface release of a riser system, the system generally comprising one or more restraining elements disposed along the length of the riser stack at predetermined points along the sea floor or beneath the mud line.

Also disclosed is a system for and method of restraining and controlling the unintended subsurface release of a subsurface riser system, in which a receiving station having one or more means for absorbing or deflecting force carried by an unintentionally released system component is disposed in a fluid transport system.

DETAILED DESCRIPTION

As seen in the attached FIGS. 1-4, some offshore exploration and production systems, especially those relying on self-standing casing riser type configurations, are potentially susceptible to a variety of system failures that could lead to the damage or destruction of associated drilling platforms and surface vessels disposed overhead (e.g., a pontoon type drilling rig floating on the surface of the ocean and disposed in communication with the riser system).

For example, casing connections, wellhead connections, buoyancy chambers connected to a riser stack, etc., can all fail, thereby creating an unsafe condition in which buoyancy and tension forces are suddenly released from a submerged exploration or production system back toward the surface of the water. When such a release occurs, the components of the system—for example, a buoyancy chamber disposed in communication with several thousand feet of casing riser—are released toward the surface and can impact an associated rig or surface vessel servicing the well.

Figure 1:
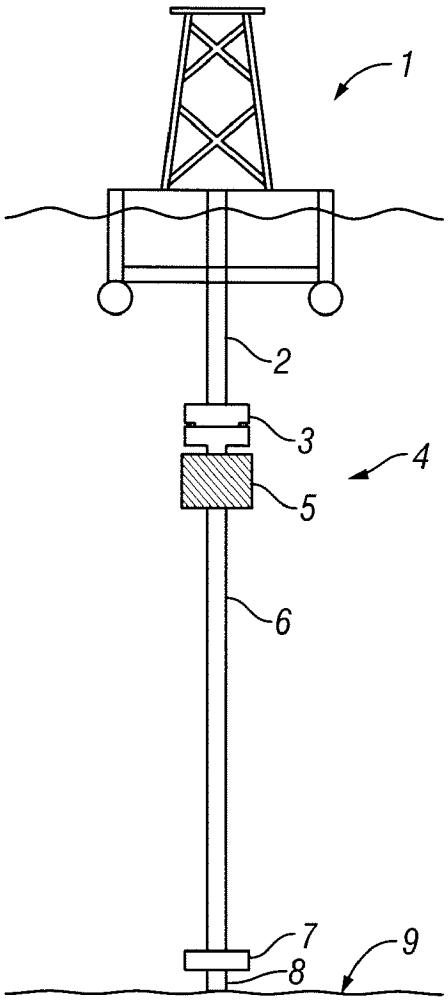
FIG. 1 is a side view of an offshore exploration and production system in which a floating mobile offshore drilling unit is connected to an upper riser stack and a blowout preventer assembly; the blowout preventer assembly is in turn connected to a conventional self-standing casing riser. The self-standing casing riser employs a buoyancy device to support the casing riser from a sea-floor wellhead.

FIG. 1, for example, is a side view of an offshore exploration and production system in which a floating mobile offshore drilling unit 1 is connected to an upper riser 2 and blowout preventer 3, which is in turn connected to a self-standing casing riser system 4. The riser system 4 employs a buoyancy device 5 to support the casing riser stack 6 from a sea-floor wellhead member 7. Wellhead member 7 is connected to the top of a well casing member 8. Well casing member 8 enters the mud line or sea floor 9.

In practice, the floating unit 1 may comprise any number of vessels or structures used as surface stations for receiving hydrocarbons produced from offshore wells. In addition to a mobile offshore drilling unit (or "MODU"), some other examples of receiving station members include: ships or other sea vessels; temporary or permanent exploration and production structures such as rigs and the like; rig pontoons; tankers; a floating production, storage and offtake ("FPSO") vessel; a floating production unit ("FPU"); and other representative receiving units as would be known to one of ordinary skill in the art.

It should be appreciated that upper riser 2 may comprise any number of structural or functional equivalents having a purpose of facilitating hydrocarbon transfer from casing riser stack 6 to the receiving station. For example, riser 2 may comprise flexible drill tubing, casing, a string of rigid pipe, etc., either contained within the interior of an outer pipe or sheath, or instead serving as a direct hydrocarbon transfer means. For purposes of this application, all such fluid communication means will generally be referred to as a "riser."

Like upper riser 2, self-standing riser system 4 also facilitates connection of one or more wellheads to one or more subsurface wells, and/or to a riser stack, a buoyancy member, etc., as dictated by operational requirements. The riser system 4 can comprise any of a number of structural or functional equivalents having a purpose of facilitating the transfer of fluids from a well to a surface or near-surface receiving station, which in some embodiments is self-standing and disposed under essentially continuous buoyant tension. The riser stack is typically made up of one or more known fluid communication devices, for example, casing riser or another suitable connecting member, such as a tubular, a length of coiled tubing, or a conventional riser pipe assembly. The buoyancy member is typically submerged in the sea, and may comprise a buoyancy chamber located in an upper portion of the riser stack. The relative buoyancy of the buoyancy member applies tension to the riser stack, thereby establishing a submerged platform of sorts from which a wellhead, blowout preventer, riser stack, etc., connected to the receiving station member may be assembled or affixed.

Figure 2:
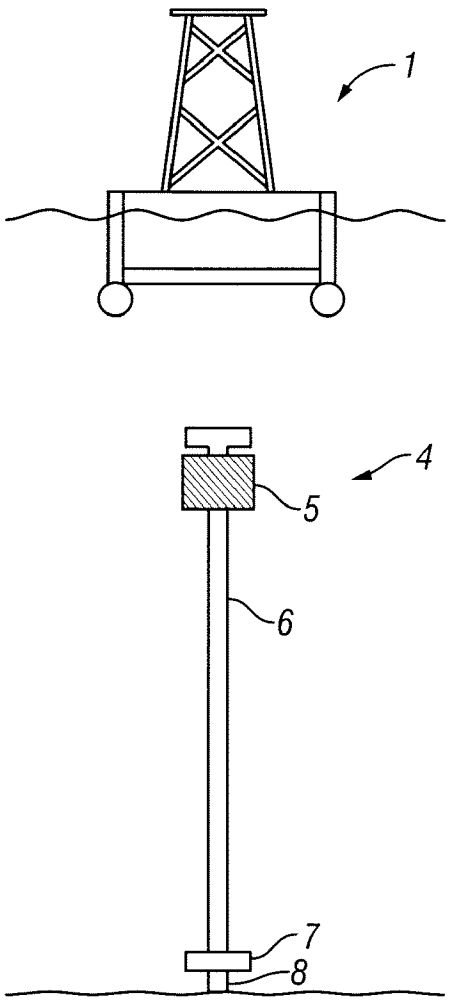
FIG. 2 is a side view of a self-standing casing riser employing a buoyancy device without an upper riser and blowout preventer assembly, wherein the casing riser is extended from a sea-floor wellhead, with a mobile offshore drilling or production unit or disposed overhead.

FIG. 2 is a side view of a self-standing riser system 4 disposed in communication with a buoyancy device 5, which lacks a conventional riser or blowout preventer and is instead capped by a well isolation member such as a ball valve, or a shear ram, etc. The buoyancy device 5 will be used to connect riser stack 6 from a sea-floor wellhead member 7 to a mobile offshore drilling unit 1 or another representative exploration or production unit floating overhead. As seen, the tension forces associated with riser stack 6 as a result of its communication with buoyancy device 5 are restrained by only wellhead member 7, which is anchored by well casing member 8 to the sea floor.

Figure 3:
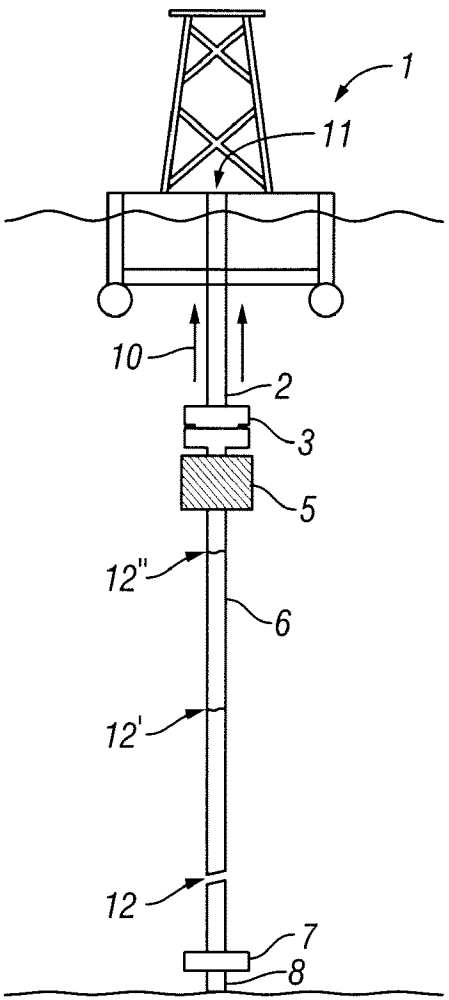
FIG. 3 is a side view of an offshore exploration and production system, with an upper riser and blowout preventer assembly, shown while undergoing catastrophic failure or release along a length of the casing riser, illustrated here by upward lines of force.

FIG. 3 is a side view of an offshore exploration and production system having an upper riser 2 and a blowout preventer 3, depicted during the initiation of an unintentional subsurface release along a length of riser stack 6, the direction of associated released forces being illustrated by upward pointing lines 10. As is clear from the depiction, this particular single point failure will cause buoyancy device 5 to launch suddenly and forcefully toward the surface. In fact, any such failure or release of the riser system 4 occurring between buoyancy device 5 and the well casing 8 will cause a buoyant, projectile-like release of the disconnected system components directly toward the mobile offshore drilling unit 1. For example, failure or release of the casing wellhead connection from the sea floor, or wellhead member 7 from well casing member 8, will set free some portion of riser stack 6 and the entirety of buoyancy device 5, thereby transferring the associated buoyancy forces to blowout preventer 3 and upper riser 2. Major damage can obviously ensue when upper riser 2 accelerates and crashes into mobile offshore drilling unit 1, thereby creating a tightly concentrated damage impact point 11 that is poorly equipped to handle the sudden and unexpected application of such enormous force. Other example points of failure or release events might include a failure point 12 occurring near the base of riser stack 6, a failure point 12' anywhere along the length of riser stack 6, and a failure point 12" occurring near the top of riser stack 6, which is also in close proximity to buoyancy device 5. In short, sudden release of the riser stack will also release all of the previously restrained buoyant and tension forces present in the system, thereby causing upper riser 2 to rush upward and possibly causing significant damage to mobile offshore drilling unit 1.

Figure 4:
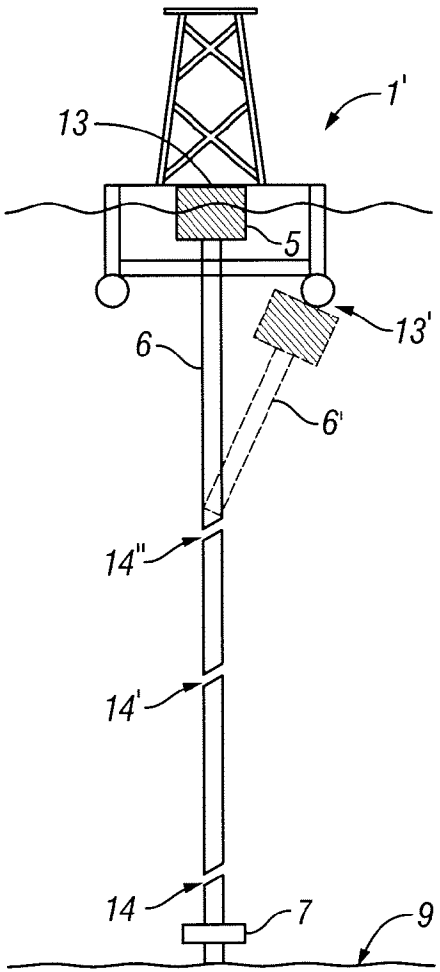
FIG. 4 is a side view of an offshore exploration and production system, depicted without an upper riser and blowout preventer assembly, undergoing catastrophic failure or unintentional release along the self-standing casing riser, further illustrating potential impact points of the buoyancy device into the overhead floating unit.

FIG. 4 is a side view of a receiving station unit 1', depicted prior to installation of an upper riser and blowout preventer assembly and while undergoing a catastrophic failure or other unintentional release along the length of the riser system 4, and further illustrating potential impact points 13, 13' of the buoyancy device 5 into the body or support members of the receiving station 1'. As seen, the riser system 4 has suffered a catastrophic system failure in which the riser stack 6 has broken off at failure point 14". Depending on the orientation of the stack 6 at the time of system failure, the buoyancy chamber 5, which was attached to riser stack 6 in order to provide tension during exploration and production, is suddenly released together with up to several thousand feet of trailing casing riser back toward the surface of the water, where it impacts vertical impact point 13 disposed near a bottom portion of a receiving station, again causing an unsafe condition in which the entire receiving station, and perhaps all or a significant percentage of associated equipment and personnel, are lost.

In the alternative, or in combination, other points of failure may occur, such as, for example, failure at points 14 and/or 14'. As those of ordinary skill in the art will readily recognize, such failures can occur as a result of mechanical failure, material decomposition attributable to corrosion, etc., or in response to bending forces applied to casing stack 6. Lateral forces, such as those resulting from cross currents associated with particular water depths, can also cause bending or breakage, and may also cause lateral deviation or inclination of the angle at which the otherwise upwardly directed forces occur in practice. As seen, a riser 6' so inclined or laterally deviated could impact a pontoon or a cross-brace, thereby creating an impact point 13' and severely damaging the receiving station member 1' and/or other floating units such as workboats or floating transmission lines.

Figure 5:
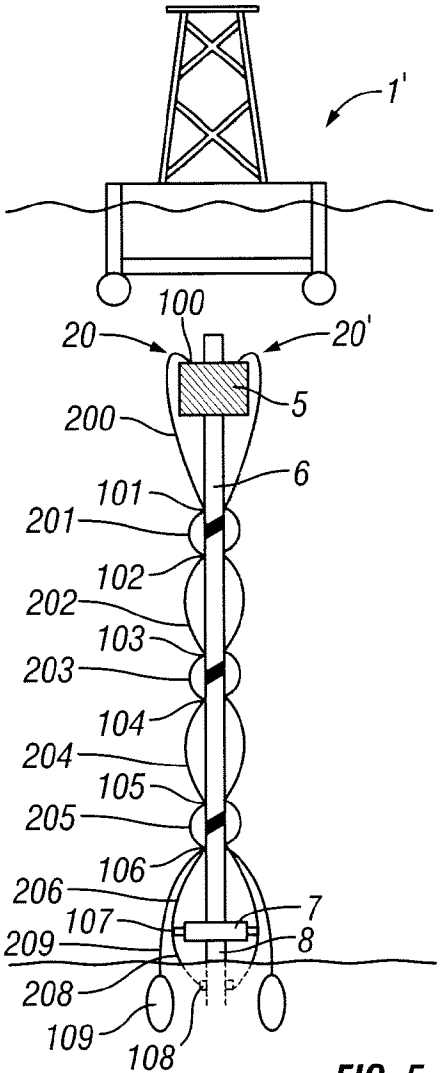
FIG. 5 is a side view of a self-standing casing riser employing a buoyancy device but without a riser and blowout preventer assembly, supporting the casing riser from a sea-floor wellhead, with an example of the restraining devices of the present invention.
Figure 6:
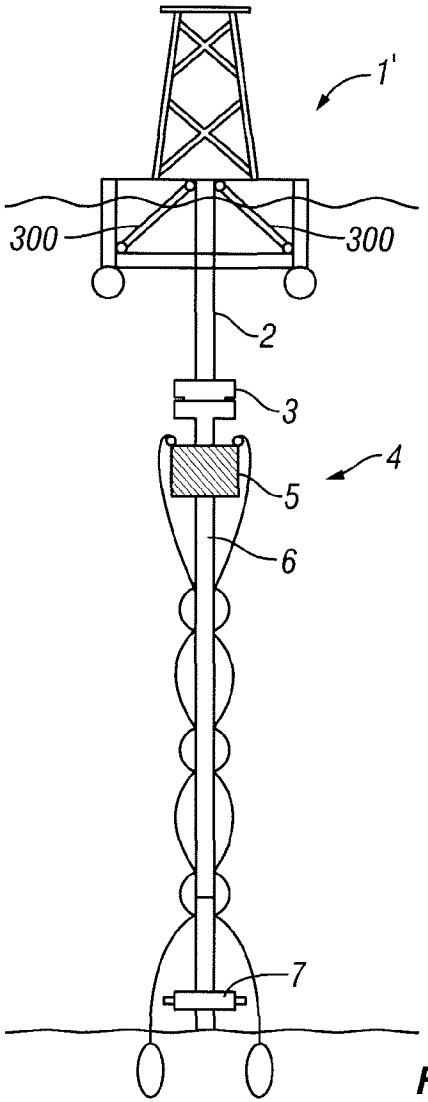
FIG. 6 is a side view of an offshore exploration and production system in which a floating mobile offshore unit is connected to an upper riser and blowout preventer assembly, which is, in turn, connected to a self-standing casing riser. In an example of the present invention, both the floating unit and the self-standing casing riser employ independent restraining and control systems.

As seen in the example embodiments of FIGS. 5-6, a catastrophic release control system is provided, comprising a network of restraining members (e.g., chains, cables, adjustable tension lines, etc.) disposed between an anchoring means and one or more predetermined points along the length of the riser stack. A number of possible connection points and means by which connection may be affected are expressly disclosed in the drawings, though one of ordinary skill in the art will appreciate that a great many other connection means and attachment points are presently contemplated, the precise nature of each being determined by operational variables, for example, the sea conditions in which operations occur, the various materials used to construct the system, the extent and significance of wave and tidal forces, etc. By pairing appropriate connection means and attachment points together with an understanding of related operational variables, a system is achieved in which the riser or casing stack is restrained even in the event of an otherwise catastrophic system failure.

Referring now to the specific, non-limiting embodiment of the invention depicted in FIG. 5, a system for controlling the unintended release of self-standing riser systems is provided, comprising a plurality of anchor points 100 through 109 disposed on the riser system with restraining members 200 through 209 connected to the anchor points. In the present depiction, the self-standing system 4 is not yet connected to overhead surface unit 1', and thus no connecting riser or blowout preventer is present. Buoyancy chamber 5 connects riser stack 6 to a sea-floor wellhead member 7, and one manner in which the restraining devices may be deployed in practice is depicted for purposes of illustration of the invention.

For example, one or more means for anchoring are illustrated by anchor points 100 through 109. In this particular embodiment, anchoring is disposed on the casing riser, buoyancy member, and bottom portions of the riser system 4. Anchor points 101 through 106 are shown in this instance as disposed on the riser stack 6 portion of the riser system 4. Anchor points 100 are disposed on the buoyancy device 5, and anchor points 107 are disposed on the wellhead member 7. Redundant or alternative anchoring may also be deployed on the sea floor, such as by connection to a template or a weighted mass, or into the sea floor or mud line using suction anchors, etc., as illustrated by anchor points 109. Additional or alternative anchoring may also be deployed on well casing member 8, as illustrated by anchor points 108.

Restraining members may be formed from any of several previously known components and materials, depending on the specific engineering, environmental, and weight bearing requirements dictated by the operational environment. Examples include, but are not necessarily limited to, chains, cable, rope, elastic cord, extension springs, and limited travel extension springs, etc. In any event, the various restraining members are attached between anchor points such that one end of a restraining member is attached to a first anchor point, while the other end of the restraining member is connected to a second anchor point. A plurality of restraining members 200 through 209 connects various portions of riser stack 6 from wellhead member 7 to buoyancy device 5, thereby affecting a network of restraining members tying points along the riser system together.

The aforementioned network of restraining members can be variably deployed in a variety of configurations. As shown in the example embodiment of FIG. 5, restraining members 201 through 209 are disposed in an interconnected, "daisy-chain" like manner, with at least two restraining members disposed upon or proximate to each of the anchor points. For example, restraining member 201 is connected to anchor point 101 and anchor point 102, while restraining member 202 is connected to anchor point 102 and anchor point 103. Similarly, restraining member 203 is connected to anchor point 103 and anchor point 104, restraining member 204 is connected to anchor point 104 and anchor point 105, restraining member 205 is connected to anchor point 105 and anchor point 106, restraining member 206 is connected to anchor point 106 and anchor point 107, etc. In the depicted embodiment, a terminal restraining member 200 is disposed on anchor point 100 of buoyancy device 5. Restraint of the riser system using chains, cables or adjustable tension lines, etc., attached to both an anchor and one or more predetermined points along the stack will prevent the chamber and casing riser from releasing and impacting an associated rig or surface vessel. In the depicted embodiment, redundant terminal restraining members are disposed on one or more of anchor points 106, 107, 108 and 109. The network forms a continuous linkage from the buoyancy member back to the sea floor foundation, in this example, a chain like assembly 20 disposed in mutual interconnection along the longitudinal entirety of casing or riser stack 6.

Continuing with reference to FIG. 5, two separate chains of restraining members are depicted, namely, chains 20 and 20', although it will be appreciated by one of ordinary skill in the art that both a single chain 20 can suffice, whereas additional restraining member chains (not illustrated) can be disposed to connect separate restraining chains in a net-like manner. For example, a number of restraining members may be disposed on a single anchor point, or in relatively close physical proximity to one another. Thus, the network of restraining members can be used to form multiple continuous linkages, wherein any particular linkage may or may not be linked to any other. In a further embodiment, some of restraining members are disposed in a staggered pattern so that various individual restraining members need not share a common anchoring point, while still forming a continuous connection along the length of the casing riser. In yet another embodiment, the network of restraining members covers only a partial span of the overall riser system.

In a still further embodiment, FIG. 5 depicts a pair of anchoring means and corresponding connections for various restraining members. For example, anchor points 101 and 102 are disposed in relatively close physical proximity with one another. Complementary restraining member 201 then connects between anchor point 101 and anchor point 102. In at least one embodiment, the portion of casing or riser stack 6 between anchor point 101 and anchor point 102 represents the location of a flange or coupling, an intentionally engineered breaking point, or a potential bending point requiring redundant anchoring for additional safety.

In short, the modified riser system, once secured by one or more networks of restraining members, prevents the unintentional, projectile-like release of a buoyancy device and associated casing riser, thereby preventing release toward the surface and avoiding possible impact with a receiving station, or with an associated rig or proximately disposed sea vessel.

Figure 7:
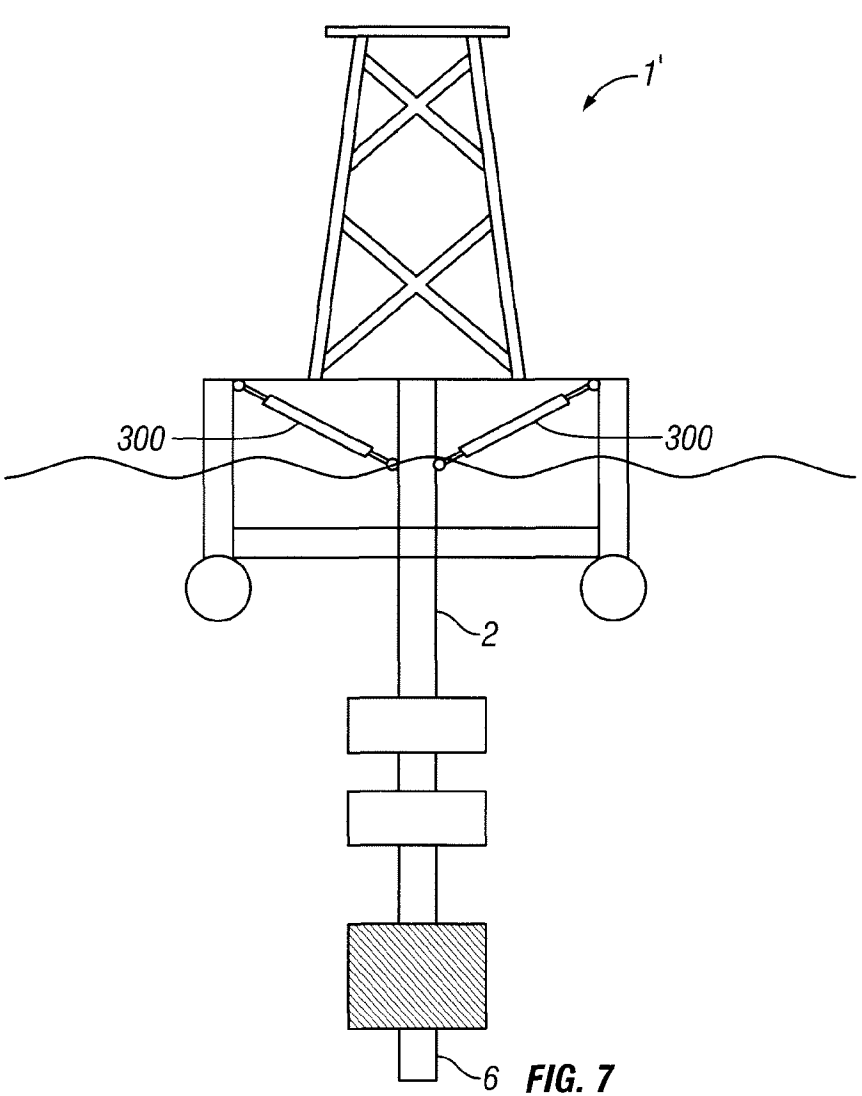
FIG. 7 is a side view of an offshore exploration and production system in which a floating mobile offshore drilling or production unit is mechanically connected to an upper riser and blowout preventer assembly; the blowout preventer assembly is in turn connected to a self-standing casing riser. In a further example of the present invention, one or more restraining and control devices are connected between the floating unit and the upper riser.

As seen in FIGS. 6-7, redundant safety features are also provided for attendant surface vessels and rigs, so that additional safety is provided for operators in the event an unintended subsurface release of casing, etc., reaches the surface despite the subsurface safety features disclosed above. For example, one or more pistons or other shock absorbing devices can be disposed near a bottom portion of a rig or platform in order to absorb and dissipate the upward energy of one or more released riser system components. Appropriate force absorbing devices may comprise a system of springs, hydraulic or gas filled cylinders, etc., and optimally are disposed in such a manner that as few of the devices as possible are required to absorb and diminish even the maximum force a sudden, uncontrolled riser release might deliver. For example, a system of springs or cylinders can be disposed on the bottom portion of a rig at an angle of approximately forty-five degrees or so (measured relative to the direction of likely riser impact) in order to absorb and dissipate incoming forces. However, any force absorbing system suitable for installation on a rig or platform, or even the bottom of a vessel, and as many such devices and angles of inclination and declination as may be required to absorb and diminish an impact force can be employed in place of the optimal configuration.

FIG. 6 is a side view of an example offshore exploration and production system in which an overhead floating production unit 1' is connected to an upper riser 2 and a blowout preventer 3. The blowout preventer 3 is disposed in mechanical communication with a self-standing casing riser system 4. In one embodiment of the invention, both the overhead floating production unit 1' and the riser system 4 employ separate restraining systems. In the event of a release or failure of the riser system, and in the absence or failure of the riser system 4 restraining member network to retard the unintended projectile-like release of subsurface system components toward the surface, one or more absorbing means disposed on overhead floating production unit 1' are employed to absorb, deflect, and otherwise reduce or intercept the force of impact associated with the released buoyancy device 5 and attendant riser stack 6. As shown in the depicted example, hydraulic springs 300 are disposed at an angle of approximately forty-five degrees on the lower infrastructure of overhead floating production unit 1', and may be employed either alone or in combination with a plurality of lower restraining members 200 through 209 (see FIG. 5) disposed on the riser system 4. Other absorbing means are also contemplated, e.g., springs, gas-filled cylinders, hydraulic cylinders, extension springs, limited travel extension springs, ventable gas-filled cylinders, etc.

In an alternate example, hydraulic springs 300 are disposed at an approximate angle of between thirty and forty-five degrees measured relative to the direction of likely riser impact. In this example, likely riser impact is approximately measured from a vertical location situated directly beneath the overhead floating production unit 1', as the wellhead member 7 in this example is directly beneath overhead floating unit F. Hydraulic springs 300 are therefore disposed on the underside of overhead floating production unit 1' at an angle of approximately thirty to forty-five degrees measured relative to the vertical, longitudinal axis of the subsurface riser stacks 2, 6. It should be appreciated, however, that a wellhead member 7 or an associated riser system 4 may also be laterally displaced from a receiving station member, and the direction of likely riser impact to a particular receiving station member may well originate from various other released system component ascension angles.

Still further means may be employed to reduce or eliminate upward, projectile-like forces in the event of a sudden, unintended riser system release. For example, a mechanical means for directly stabilizing an unintentionally released buoyancy member will help to constrain the angular sweep of potential impact locations, and reduce the incoming projectile-like forces prior to impact. Such means, when disposed in communication with either a means disposed on the receiving station member for absorbing impact or a network of restraining members disposed on the riser network, or both, will cumulatively reduce the chance for serious damage from failure or unintended release of the riser system.

One means for stabilization of the buoyancy member comprises a means to reduce rotation of the buoyancy member in the event of inadequate anchoring or the unintended projectile-like motion of the buoyancy member. In one example, a plurality of baffling members (not shown) is disposed around the periphery of the cylindrical outer surfaces of buoyancy device 5. In another example, a plurality of fin-like planes are disposed on and extend outwardly from the outer surfaces of buoyancy device 5. In one particular example, a plurality of plane-like or curved fin members are disposed around the periphery of the cylindrical surfaces of buoyancy device 5, thereby providing resistance to otherwise uncontrolled rotational forces, which can result in excessive stress forces on the restraining members 200 through 209 (see FIG. 5). In short, baffling, fins and other such devices lend additional stability to both dynamically positioned and relatively fixed buoyancy chamber systems by controlling lateral underwater currents, and retarding rotation of the buoyancy chamber, which in turn can greatly reduce or prevent shearing forces on riser stack 6 and subsurface wellhead member 7.

Yet another means for stabilizing the unintended release of a buoyancy chamber comprises a means for swamping the buoyancy member upon detection of release of the riser system. In one example, a series of pressure sensitive latches are disposed on the upper surfaces of the buoyancy member. The latches collapse when pressure outside the buoyancy member greatly exceeds the pressure inside the buoyancy member, as would be the case when a riser system having a buoyancy member is suddenly released toward the surface in an uncontrolled manner. In this embodiment, seawater swamps the buoyancy member and retards the buoyant force with which the released riser system approaches the surface of the water. The means for facilitating the swamping of the chamber can function either directly (for example, in the case where latches are formed from a material sufficiently weaker than the surrounding chamber materials that the latches will collapse during the normal course of sudden release) or indirectly (as when collapse of the latches is initiated by a differential pressure sensor or the like).

FIG. 7 is a side view of an offshore exploration and production system in which the overhead floating production unit 1' is connected to an upper riser 2 and a blowout preventer assembly; the blowout preventer is in turn mechanically connected to a lower riser stack 6. In still another example of the invention, a plurality of restraining devices can be connected between the overhead floating unit 1' and the upper riser 2. As shown in the depicted example, hydraulic springs 300' are disposed on the underside infrastructure of overhead floating production unit 1'. Other means may be employed, such as the use of springs, gas-filled cylinders, hydraulic cylinders, extension springs, limited travel extension springs, ventable gas-filled cylinders, etc. In this particular example, hydraulic springs 300' are disposed at a declination angle of approximately thirty to forty-five degrees measured relative to the direction of likely riser impact.

The foregoing specification is provided for illustrative purposes only, and is not intended to describe all possible aspects of the present invention. Moreover, while the invention has been shown and described in detail with respect to several exemplary embodiments, those of ordinary skill in the pertinent arts will appreciate that changes to the description, and various other modifications, omissions and additions may also be made without departing from either the spirit or scope thereof.

The invention claimed is:

1. A method for restraining the release of a subsurface riser system equipped with an adjustable buoyancy chamber, said method comprising the steps of:

disposing a well casing in communication with an offshore well;

disposing a lower connecting member in communication with said well casing;

disposing said lower connecting member in communication with an upper connecting member;

disposing an approximately annular adjustable buoyancy chamber in communication with said lower connecting member and said upper connecting member, and equipping said buoyancy chamber with means to adjustably increase and decrease an interior fluid volume content using a fluid volume content control means;

attaching one or more restraining members to one or more predetermined restraint points along a length of said riser system; and anchoring said one or more restraining members to one or more anchoring members so that said adjustable buoyancy chamber does not rise to the surface in an uncontrolled manner in the event of a failure of said length of riser system.

2. The method of claim 1, wherein said step of disposing one or more restraining members further comprises a step of disposing one or more restraining members on at least one surface of said adjustable buoyancy chamber.

3. The method of claim 1, wherein said step of disposing one or more restraining members further comprises a step of disposing one or more restraining members on at least one longitudinal portion of an upper riser segment disposed above said adjustable buoyancy chamber.

4. The method of claim 1, wherein said step of disposing one or more restraining members further comprises a step of disposing one or more restraining members on at least one longitudinal portion of a lower riser segment disposed beneath said adjustable buoyancy chamber.

5. The method of claim 1, wherein said step of anchoring said one or more restraining members to one or more anchoring members further comprises anchoring to an associated well casing.

6. The method of claim 1, wherein said step of anchoring said one or more restraining members to one or more anchoring members further comprises anchoring to an associated sea floor surface.

7. The method of claim 6, wherein said step of anchoring to an associated sea floor surface further comprises a step of disposing one or more anchoring members on at least one portion of the sea floor disposed beneath the mud line.

8. The method of claim 1, wherein said step of attaching one or more restraining members to one or more predetermined restraint points along a length of said riser system further comprises a step of attaching a restraining member between a first predetermined failure point and a second predetermined failure point disposed along a length of the riser system.

9. The method of claim 1, wherein said step of attaching one or more restraining members to one or more predetermined restraint points along a length of said riser system further comprises a step of attaching at least one restraining member between said adjustable buoyancy chamber and a predetermined point along a length of said riser system.

10. The method of claim 1, wherein said step of attaching one or more restraining members to one or more predetermined restraint points along a length of said riser system further comprises a step of attaching at least one restraining member between a predetermined point along a length of said riser system and a wellhead disposed in communication with said system.

11. The method of claim 1, wherein said step of attaching one or more restraining members to one or more predetermined restraint points along a length of said riser system further comprises a step of attaching at least one restraining member between a predetermined point along a length of said riser system and a predetermined point beneath a wellhead associated with said system.

12. The method of claim 1, wherein said step of attaching one or more restraining members to one or more predetermined restraint points along a length of said riser system further comprises a step of attaching at least one restraining member between a predetermined point along a length of said riser system and a predetermined point disposed beneath the sea floor mud line.

13. The method of claim 1, wherein said step of attaching one or more restraining members to one or more predetermined restraint points along a length of said riser system further comprises a step of attaching at least one restraining member between a first predetermined point and a second predetermined point located along one or more lengths of said riser system, wherein said first predetermined point and said second predetermined point are disposed in functionally close proximity to one another, thereby creating an effective restraining pair.

14. The method of claim 13, wherein said step of attaching one or more restraining members further comprises a step of attaching at least one additional restraining member between said first predetermined point and said second predetermined point of said restraining pair.

15. A system for restraining the release of a subsurface riser system equipped with an adjustable buoyancy chamber, said system comprising:

a well casing disposed in communication with an offshore well;

a lower connecting member disposed in communication with said well casing and an upper connecting member;

an approximately annular adjustable buoyancy chamber disposed in communication with said lower connecting member and said upper connecting member, wherein said buoyancy chamber is equipped with means to adjustably increase and decrease an interior fluid volume content using a fluid volume content control means;

one or more restraining members disposed at one or more predetermined restraint points along a length of said riser system; and one or more anchoring members disposed in communication with said one or more restraining members such that said adjustable buoyancy chamber will not rise to the surface in the event of a failure of said length of riser system.

16. The system of claim 15, wherein said system further comprises one or more restraining members attached to at least one surface of said adjustable buoyancy chamber.

17. The system of claim 15, wherein said system further comprises one or more restraining members attached to at least one longitudinal portion of an upper riser segment disposed above said adjustable buoyancy chamber.

18. The system of claim 15, wherein said system further comprises one or more restraining members attached to at least one longitudinal portion of a lower riser segment disposed beneath said adjustable buoyancy chamber.

19. The system of claim 15, wherein said system further comprises one or more restraining members attached to at least one portion of an associated well casing.

20. The system of claim 15, wherein said system further comprises one or more restraining members attached to at least one portion of an associated sea floor surface.

21. The system of claim 20, wherein said system further comprises one or more restraining members attached to at least one portion of the sea floor disposed beneath the mud line.

22. The system of claim 15, wherein said system further comprises at least one restraining member disposed between a first predetermined failure point and a second predetermined failure point disposed along a length of the riser system.

23. The system of claim 15, wherein said system further comprises at least one restraining member disposed between said adjustable buoyancy chamber and a predetermined point along a length of said system.

24. The system of claim 15, wherein said system further comprises at least one restraining member disposed between a predetermined point along a length of said riser system and a wellhead disposed in communication with said system.

25. The system of claim 15, wherein said system comprises at least one restraining member disposed between a predetermined point along a length of said riser system and a predetermined point beneath a wellhead associated with said system.

26. The system of claim 15, wherein said system further comprises at least one restraining member disposed between a predetermined point along a length of said riser system and a predetermined point beneath the sea floor mud line.

27. The system of claim 15, wherein said system further comprises at least one restraining member disposed between a first predetermined point and a second predetermined point located along one or more lengths of said riser system, wherein said first predetermined point and said second predetermined point are disposed in functional proximity to one another, thereby constituting an effective restraining pair.

28. The system of claim 27, wherein said system further comprises at least one additional restraining member disposed between said first predetermined point and said second predetermined point of said restraining pair.

* * * * *